US009570798B1

(12) United States Patent
Johnson

(10) Patent No.: US 9,570,798 B1
(45) Date of Patent: Feb. 14, 2017

(54) PROTECTED BICONICAL ANTENNA ASSEMBLY WITH BALUN FEED

(71) Applicant: Greg Johnson, Aptos, CA (US)

(72) Inventor: Greg Johnson, Aptos, CA (US)

( * ) Notice: Subject to any disclaimer, the term of this patent is extended or adjusted under 35 U.S.C. 154(b) by 28 days.

(21) Appl. No.: 14/666,140

(22) Filed: Mar. 23, 2015

Related U.S. Application Data

(60) Provisional application No. 61/968,879, filed on Mar. 21, 2014.

(51) Int. Cl.

| | |
|---|---|
| ***H01Q 1/42*** | (2006.01) |
| ***H01Q 13/04*** | (2006.01) |
| ***H01Q 1/50*** | (2006.01) |
| ***H01Q 1/36*** | (2006.01) |

(52) U.S. Cl.
CPC ..... *H01Q 1/42* (2013.01); *H01Q 1/36* (2013.01); *H01Q 1/50* (2013.01); *H01Q 13/04* (2013.01)

(58) Field of Classification Search
None
See application file for complete search history.

(56) References Cited

U.S. PATENT DOCUMENTS 3,942,180 A * 3/1976 Rannou ..... H01Q 19/06 343/725
8,654,025 B1 * 2/2014 Brock ..... H01Q 13/04 343/752

* cited by examiner

*Primary Examiner* — Robert Karacsony
(74) *Attorney, Agent, or Firm* — Billion & Armitage; John F. Klos

(57) ABSTRACT

An antenna assembly including a pair of sheet conductive elements directed in divergent directions, with the conductive elements including a conical sheet conductor and a cylindrical sheet conductor, and a plurality of radiating conductors conductively attached to and extending away from the sheet conductors. A feed point is defined between the conical sheet conductors of the pair of conductive elements. A balun is coupled to the feed point and a tubular radome protects at least portions of the plurality of radiating conductors.

20 Claims, 11 Drawing Sheets

PROTECTED BICONICAL ANTENNA ASSEMBLY WITH BALUN FEED

RELATED APPLICATIONS

This application claims the benefit of U.S. Provisional Application No. 61/968,879, filed Mar. 21, 2014, and incorporated herein by reference.

TECHNICAL FIELD

The invention relates generally to antennas for operation over multiple frequency bands and more particularly to electronic systems intended to detect or suppress (e.g., prevent, disrupt, jam, interfere with or otherwise disable) radio frequency transmissions between transmitters and receivers occurring within particular frequency bands.

BACKGROUND OF THE INVENTION

Radio frequency ("RF") transmission systems and the various wireless devices that operate within such systems are commercially widely available, and nearly ubiquitous, throughout the world with systems coming on-line daily even in the remotest areas of the world.

Existing antennae such as conventional dipoles and monopoles suffer from a number of limitations, including narrow frequency coverage, heavy weight, and high visual profile. Dipoles or monopoles with larger cross-sectional area, referred to as "fat" dipoles, provide increased bandwidth, however, are limited to a 3.5:1 frequency bandwidth before the E plane radiation pattern splits into two lobes with a null perpendicular to the antenna major axis. The discone antenna is capable of operation over frequency bandwidths of 10-15:1, however, the beam peak varies considerably from the horizon with frequency, thus affecting useful range. Biconical dipoles that are symmetrical are well known, but provide limited capability, e.g., provide bandwidths comparable to "fat" dipoles.

Existing antennae, such as disclosed in Applicant's U.S. Pat. No. 8,059,050, include relatively exposed radiating elements constructed of flexible wire or the like. The flexible radiating elements are exposed and can deflect in response to contact with obstacles and then return to position. In some environments and situations the flexible radiating elements may be excessively deformed and fail to return to position. This excessive deformation of the radiating elements may lead to degradation of the antenna's electrical performance. A need therefore exists for an antenna assembly offering protection against damage to the radiating elements.

In light of these and other limitations, dangers and risks associated with RF transmission systems, what is needed is a system and method for detecting or suppressing (e.g., preventing, disrupting, jamming, interfering with or otherwise disabling) RF transmissions between target transmitters and/or target receivers operating in a particular region, thereby disabling the communication, the remote detonation or otherwise suppressing the RF transmissions.

SUMMARY OF THE INVENTION

To achieve the foregoing objects, and in accordance with the purpose of the invention as embodied and broadly described herein, a multiple element antenna assembly for a radio frequency communication device is provided.

Embodiments of the invention include a protected antenna assembly defining a pair of divergent conical radiating structures each including a sheet conductor and a plurality of radiating conductors attached to the sheet conductor and extending in a predetermined form and direction. The sheet conductors each include conical and cylindrical sections.

A balun is used to prevent radiation of a coax feedline used to connect the antenna to a transmitter/receiver. A frequency range can be optimized by use of a coiled-coax balun including a ferrite rod placed within the coiled-coax solenoid.

A compact, ruggedized, extremely-wide bandwidth antenna is disclosed. The antenna is suitable for operation over a frequency range of at least 80 to 11,000 MHZ. A protected antenna assembly including one or more dielectric enclosures or radomes is provided. The antenna assembly may include a polycarbonate tube consisting of one or more sections.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE INVENTION

The foregoing and other features and advantages of the invention will be apparent from the following description of embodiments hereof as illustrated in the accompanying drawings. The accompanying drawings, which are incorporated herein and form a part of the specification, further serve to explain the principles of the invention and to enable a person skilled in the pertinent art to make and use the invention. The drawings are not all to scale.

DETAILED DESCRIPTION OF THE INVENTION

Figure 1:
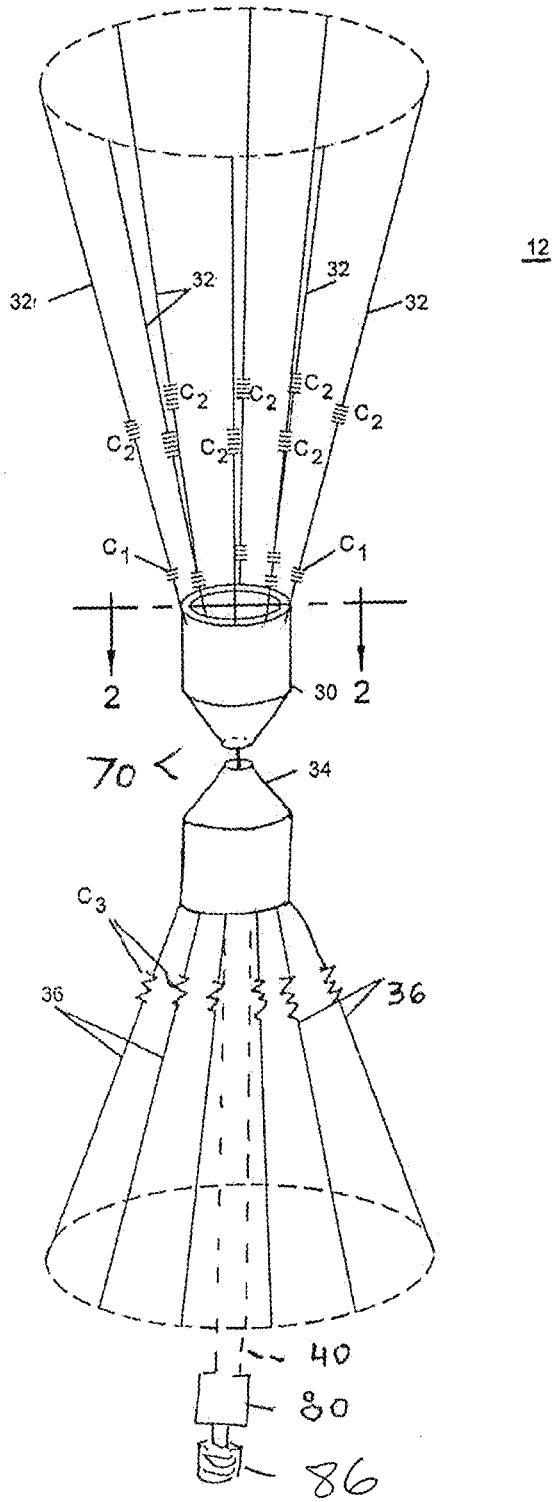
FIG. 1 illustrates an antenna assembly in accordance with the present invention.

Referring to FIG. 1, one embodiment of an antenna assembly is designated by numeral 12 and includes an upper portion having a first sheet conductor 30 with a plurality of conductively attached radiating conductors 32 aligned and held into a conical shape. The lower portion of antenna 12 includes a second sheet conductor 34 with a number of flexible radiating conductors 36 conductively attached and formed into a partial conical shape. Conductors 36 of the lower portion of antenna 12 are spaced over approximately 180 degrees. Sheet conductors 30, 34 are thin sheet metal formed into illustrated shapes. Additional details of conductors 32, 36 are disclosed in Applicant's U.S. Pat. No. 8,059,050, incorporated herein by reference. An antenna feedpoint 70 is established between the pair of sheet conductors 30, 34. A center conductor of a coax signal line 40 is connected to lower end of the first sheet element 30 and the shield conductor of the coax signal line 40 is connected to an upper end of second sheet element 34. A balun 80 is formed by encircling a portion of coax line 40 around a ferrite core. Coax line is coupled to coax connector 86, for example, to a transceiver.

Figure 2:
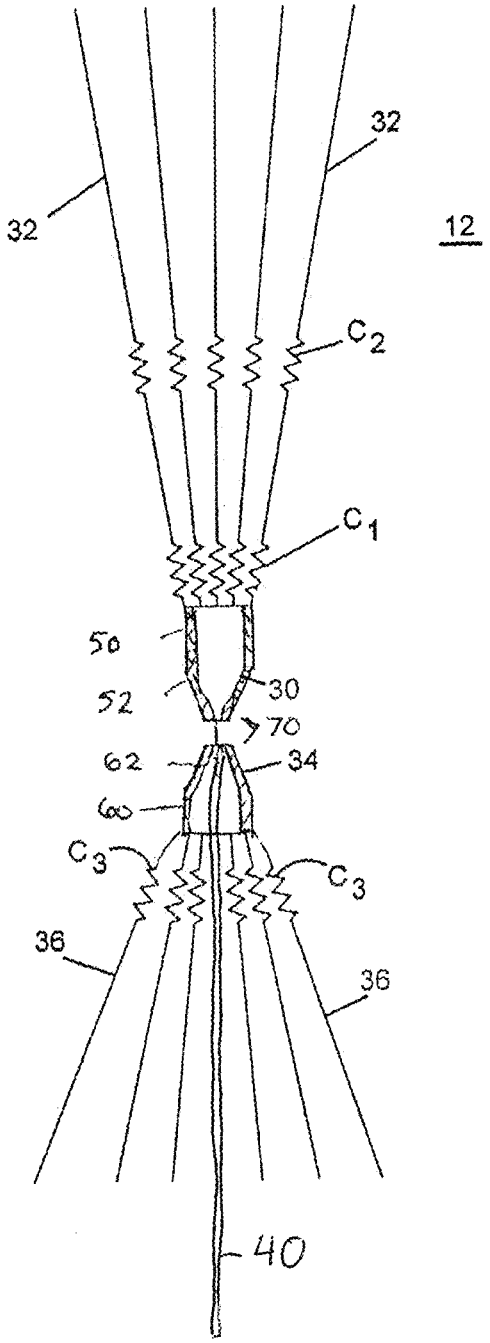
FIG. 2 depicts a cross-sectional view of the antenna assembly of FIG. 1 taken along lines 2-2.

Referring to FIG. 2, first sheet conductor 30 includes a generally cylindrical sheet element 50 positioned atop a generally cone-shaped sheet element 52. Sheet conductor 30 may be formed of thin metal elements which are soldered or welded together. Similarly, second sheet conductor 34 includes a generally cylindrical sheet element 60 positioned beneath a generally conical sheet element 62. In a preferred embodiment of the invention, the cylindrical sheet element 50 is approximately 1 inch in diameter and 1 inch in length, and the cone-shaped sheet element 52 is approximately ¾ inch in length.

Together the first and second sheet conductors 30, 34 provide broadband operation for the antenna over a large frequency range in the upper part of the antenna's frequency range. In comparison, the wire conductors 32, 36 provide for operation over the lower frequency range of the antenna.

Antenna 12 incorporates multiple radio frequency chokes (C1, C2, C3) in the radiating conductors 32, 36. The RF chokes may be simple conductive coils. Chokes C1, C2, C3 facilitate operation over a frequency range of approximately 34:1 by acting as band stops for a higher radio frequency current frequency band, while permitting rf current at a lower frequency band to pass. The number of turns and turn spacing of chokes C1, C2, C3 are selected for optimum performance over frequency bands of interest.

Figure 3:
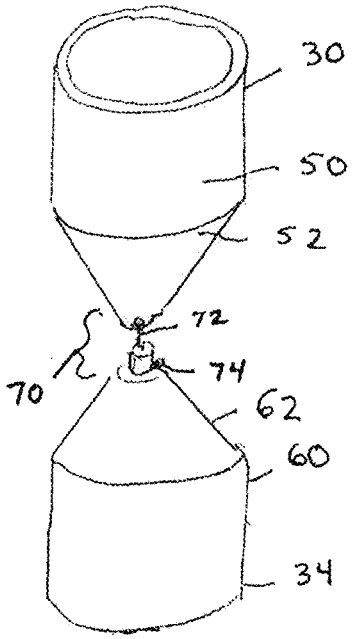
FIG. 3 is a detailed view of a portion of the antenna assembly of FIG. 1

Referring to FIG. 3, an antenna feedpoint 70 is established between the pair of sheet conductors 30, 34. A center conductor 72 of a coax signal line 40 is connected to lower end of the first sheet element 30 and the shield conductor 74 of the coax signal line 40 is connected to an upper end of second sheet element 34.

Figure 4:
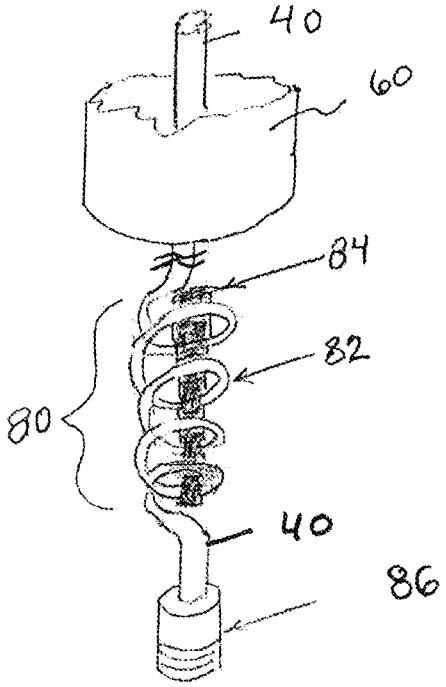
FIG. 4 is a detailed view of a portion of the antenna assembly of FIG. 1.

FIG. 4 is a detailed illustration of the antenna 12 showing the balun 80 formed by a coiled section 82 of coax 40 surrounding a ferrite (magnetic) rod 84. Coax 40 is coupled to a coax connector 86.

Figure 5:
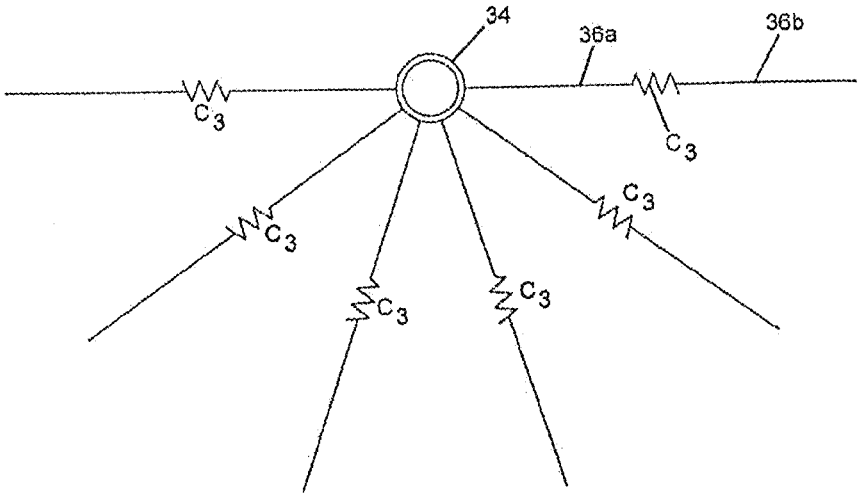
FIG. 5 illustrates a bottom view of the antenna assembly with the wire conductors arranged about sheet conductor 34.
Figure 6:
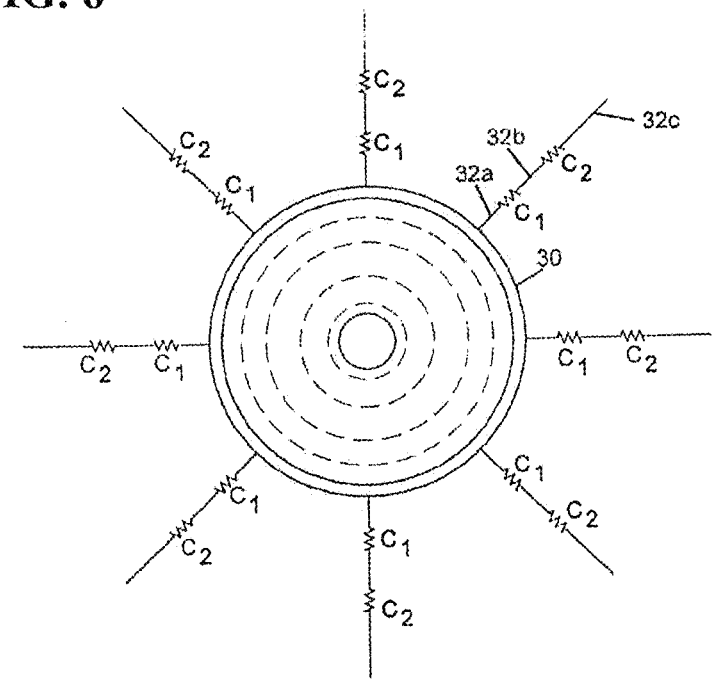
FIG. 6 illustrates the a top view of the antenna assembly with the wire conductors 32 arranged about sheet conductor 30.

FIG. 5 and FIG. 6 are views of antenna 12 taken along the antenna's major axis. FIG. 5 is a view taken from beneath the lower portion antenna 12 of FIG. 2 and FIG. 6 is a view taken from above the upper portion of antenna 12 of FIG. 2.

Figure 7:
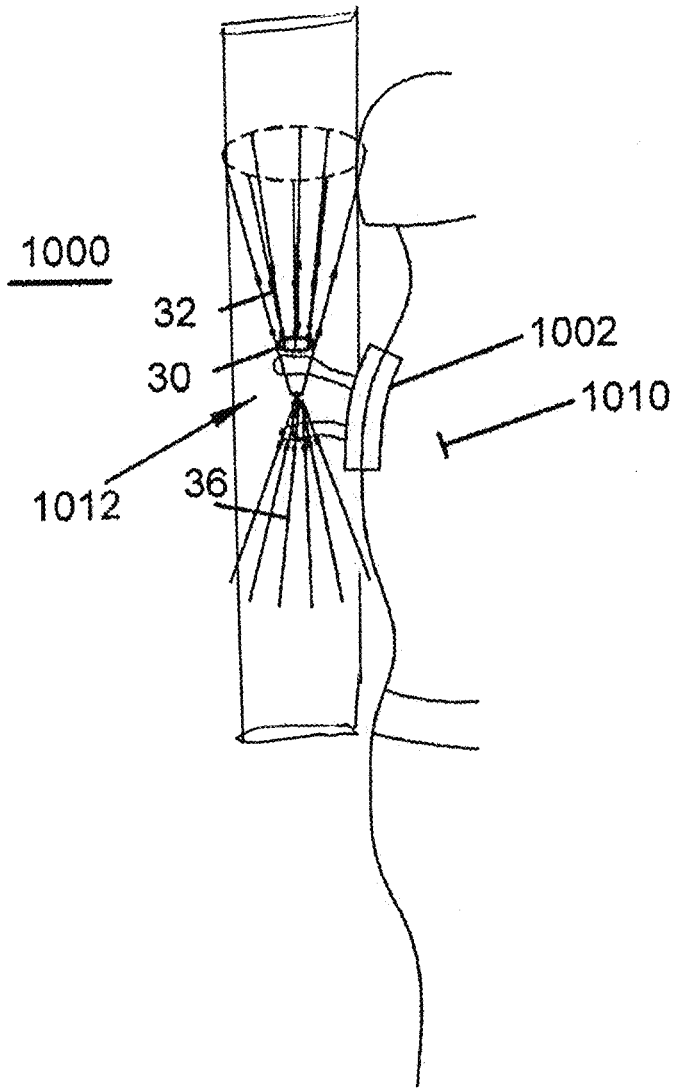
FIG. 7 illustrates another embodiment of the antenna assembly adapted to be worn by a human.

FIG. 7 is an exemplary illustration of a transceiver and antenna system 1000 adapted for transportation on a vest 1010. Transmitting unit 1000 includes a transceiver 1002 and antenna 1012 and may include mounting members that enable transmitting unit 1000 to be mounted to a standard protective vest. In other embodiments, vest 1010 may be adapted specifically for carrying transmitting unit 1000. For example, protective vest 1010 may include a pouch, straps, or other adaptations (not shown) for carrying transmitting unit 1000.

Figure 8:
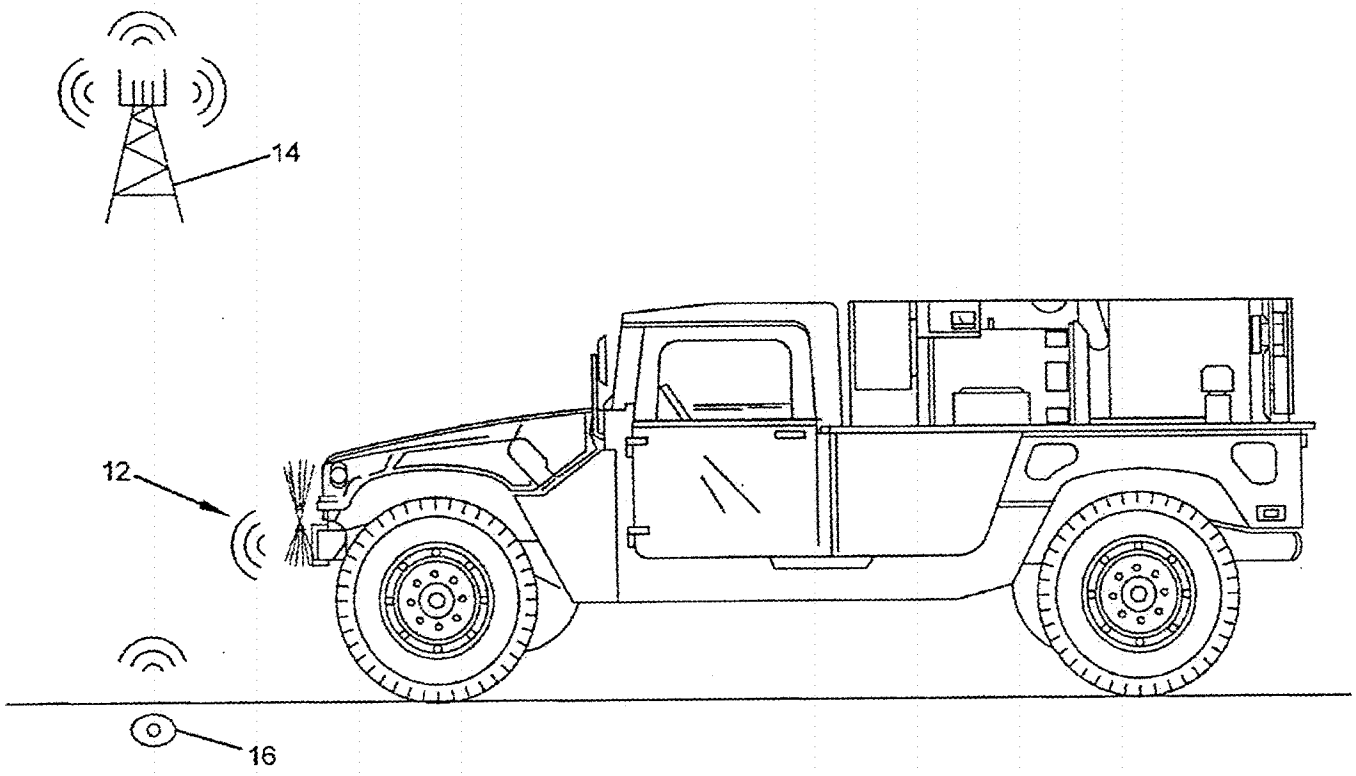
FIG. 8 illustrates another embodiment of the antenna assembly adapted to be vehicle mounted.

FIG. 8 is an exemplary illustration of a transmitting unit adapted for use on a vehicle, such as the US military's HMMWV. Transmitting unit includes a transceiver 14 and antenna 12 and may include mounting members (not shown) that enable transmitting unit to be mounted to a standard military vehicle. In other embodiments, a transmitting unit may be adapted for air-based platforms, including but not limited to unmanned aerial vehicles. Antenna 12 can be used with a transceiver in a defensive manner to detect or suppress RF transmissions from remote transceiver 14 and/or target receiving device 16.

In some embodiments of the invention, the transceiver may operate (selectably or preset) in frequency bands associated with various mobile telephones, such as, 900 MHz, 2.4 GHz, or other wireless telephone frequency bands. Other mobile telephone frequency bands may include "customized" frequency bands that commercial mobile telephone receivers and transmitters may not be to operate at "out of the box." For example, the "customized" frequency bands may include frequency bands that hostile parties have been able to use in the past (e.g., for remote detonation of IEDs and/or communication) by modifying commercially available wireless telephone components. In some embodiments of the invention, the transceiver may operate (selectably or preset) in frequency bands associated with various short range wireless devices such as an electronic car key, a garage door opener, a remote control, or other short range wireless device. In some embodiments of the invention, the transceiver may operate with various combinations of the wireless frequency bands, the wireless telephone frequency bands, and/or the short range wireless device frequency bands.

In some embodiments, the transceiver may transmit in two, three, four, five, or more different frequency bands. For example, in some embodiments of the invention, the transceiver may operate (selectably or preset) in one or more of the same frequency bands as commercially available wireless communication devices, such as, but not limited to, GSM, CDMA, TDMA, SMR, Cellular PCS, AMPS, FSR, DECT, or other wireless frequency band.

In some embodiments of the invention, the transceiver may detect RF transmissions to a wireless device located within a volume of influence of the detecting transceiver. This volume of influence may be based on various factors including a range between the target wireless device and the transceiver, a range between the target wireless device and the target transmitter, a range between the target transmitter and the transceiver, a transceiver power, a target transmitter power, a target receiver sensitivity, a frequency band or bands of the transceiver, propagation effects, topography, structural interferers, characteristics of an antenna at the transceiver including gain, directionality, and type, and other factors In some embodiments of the invention, the volume of influence may be selected or predetermined to be larger than a volume impacted by the detonation of the IED (i.e., the detonation volume or "kill zone"). In some embodiments of the invention, the volume of influence may be selected or predetermined based on whether the transceiver is stationary (e.g., at or affixed to a building or other position) or mobile (e.g., in or affixed to a vehicle, person, or other mobile platform).

In those embodiments where the transceiver is mobile, the volume of influence may be selected or predetermined based on a speed, either actual or expected, of the mobile platform. In some embodiments of the invention, multiple antennas and transmitters may be used to define an aggregate volume of influence. This aggregate volume of influence may be used to detect and/or suppress RF transmissions around a stationary position such as, for example, a base, a building, an encampment or other stationary position, or a mobile position such as a convoy of vehicles, a division of troops or other mobile position. In further embodiments, the multiple antennas and transceivers may also transmit at different frequencies to suppress RF transmissions from a wide variety of wireless devices.

In some embodiments, the invention may be sized and/or configured to be mounted in, affixed to, or otherwise carried in a military vehicle or a civilian vehicle (e.g., an armored civilian vehicle) such as HMMWV or other military vehicle, a GMC Tahoe, a Chevrolet Suburban, a Toyota Land Cruiser, or other civilian vehicle. In some embodiments, the invention may be sized and/or configured to be carried by a person in a backpack, case, protective vest, body armor or other personal equipment or clothing.

In some of these embodiments, an antenna operating with the transceiver may be affixed to a head apparatus of the person, such as a hat or helmet, or be hand-held. In some embodiments, various components of the antenna may be housed in a ruggedized, sealed, and/or weatherproof container capable of withstanding harsh environments and extreme ambient temperatures.

Figure 9:
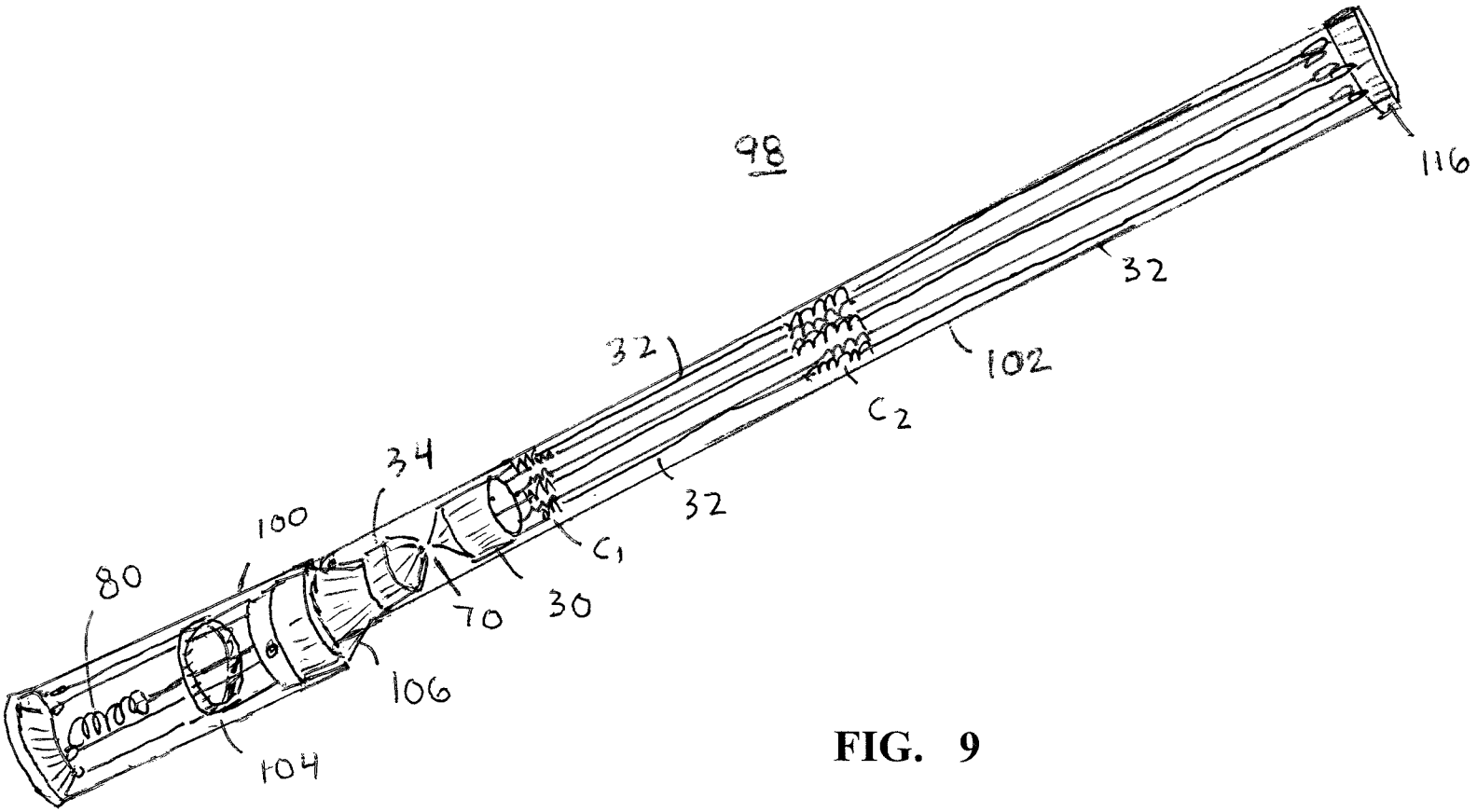
FIG. 9 is a perspective view of another embodiment of the present invention.
Figure 10:
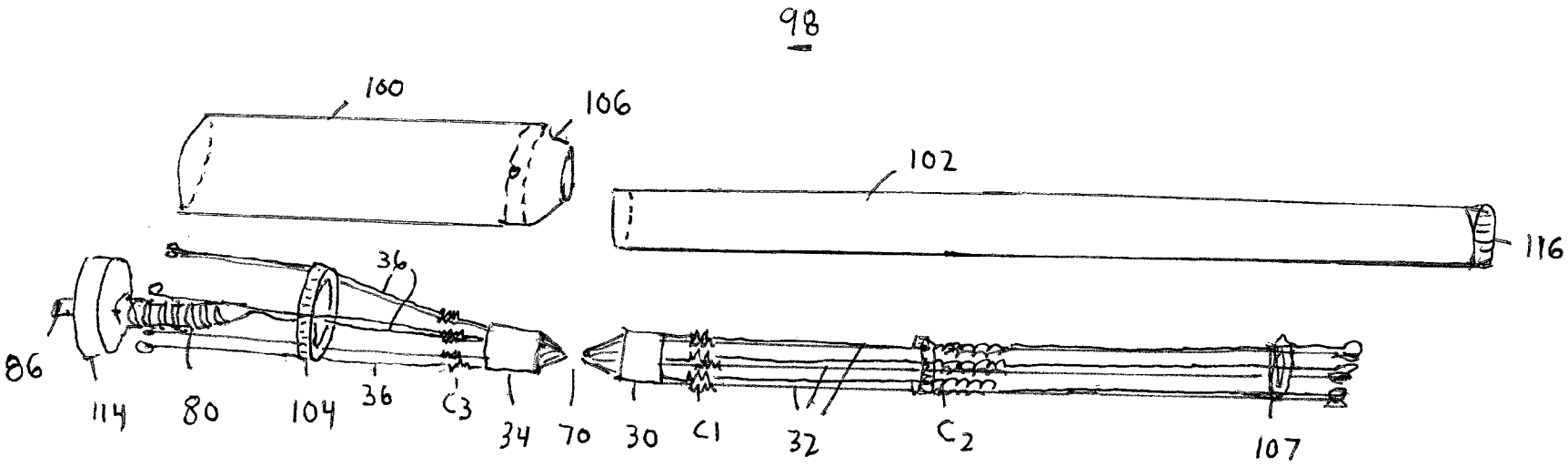
FIG. 10 is a perspective exploded view of the antenna assembly embodiment of FIG. 9.
Figure 11:
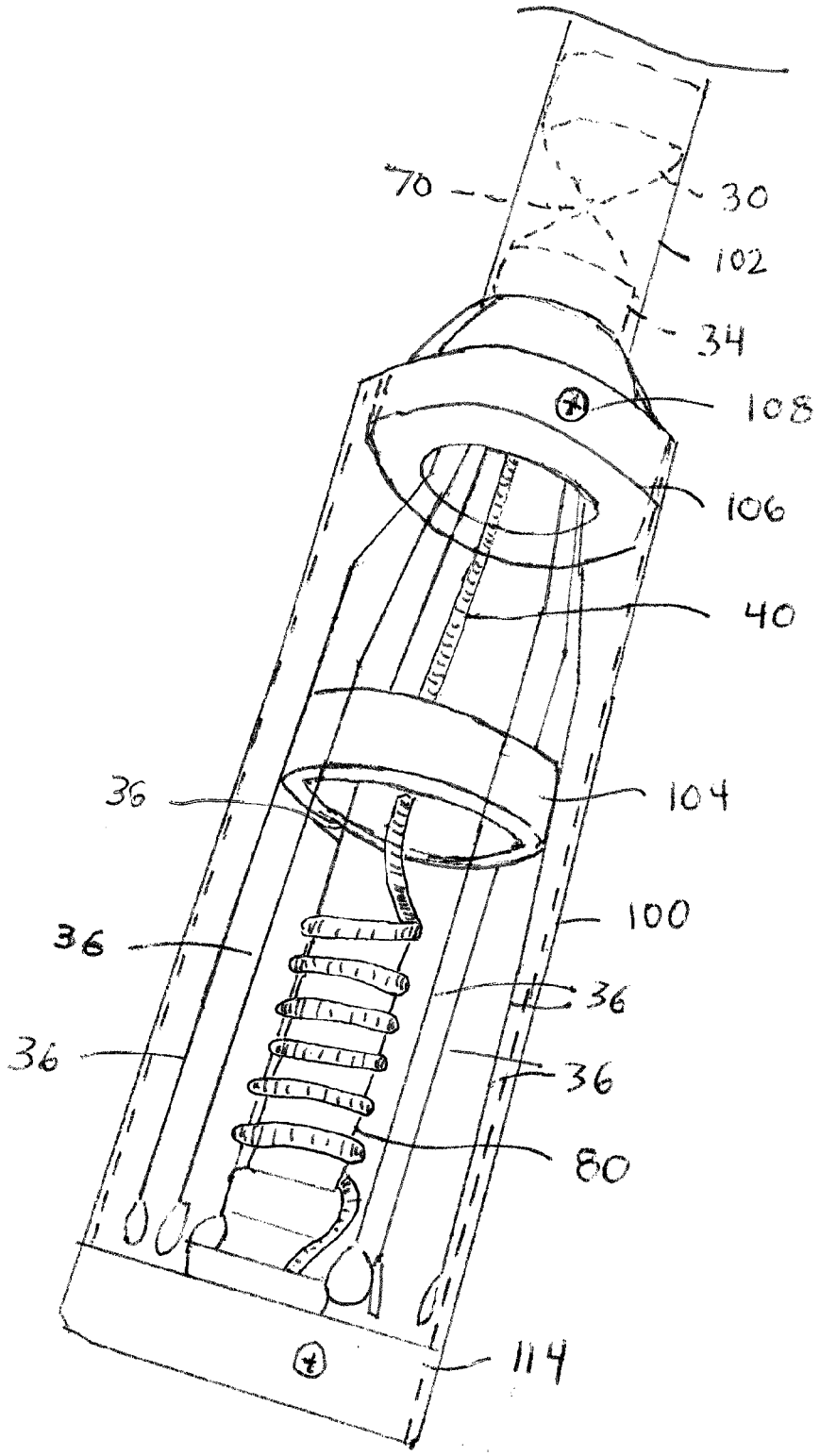
FIG. 11 is a detailed view of a portion of the antenna assembly of FIG. 9.

FIGS. 9-11 illustrate another embodiment of an antenna assembly 98. A lower polycarbonate radome section 100 and an upper radome section 102 protect internal components, including wire radiating elements. The lower spring wire radiating elements 36 are separated and electrically connect to the bottom half of feed element (sheet conductor 34). A lower dielectric spacer 104 functions to keep wire elements 36 separated within radome section 100. Another dielectric spacer 106 functions as a transition between the radome sections 100, 102. Spacer 106 may be inserted into an end of lower radome section 100. Upper radome section 102 may be inserted into spacer 106 to mechanically connect the two radome sections 100, 102 together. Another dielectric spacer 107 functions to keep wire elements 32 separated within upper radome section 102. Lower radome section 100 may be secured to spacer 106 with threaded fasteners 108. A balun RF choke 80 is also included. Balun 80 includes a spiral portion of coax signal line 40 wound around a ferrite core (or other magnetic material).

Figure 12:
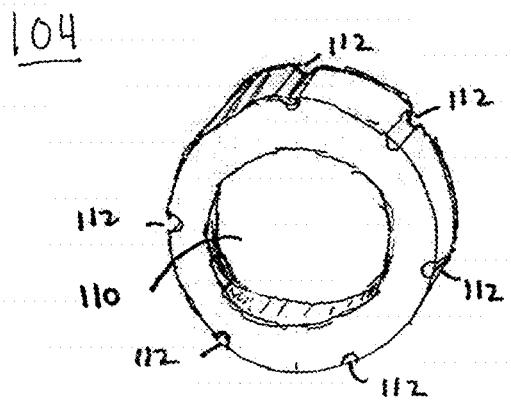
FIG. 12 is a perspective view of a spacer element of the antenna assembly of FIG. 9.

FIG. 12 shows dielectric spacer 104 having an open central portion 110 and spaced channels 112 for receiving portions of the wire elements 36. Dielectric spacer 107 would be similar but need not have an open central portion. A pair of caps 114, 116 are used to seal off the ends of the radome sections 100, 102.

The radome sections 100, 102 are preferably polycarbonate tubular elements, though alternative materials could be utilized. A foam filler (not shown) can be inserted into the radome section 100, 102 cavities to further lock the flexible radiating elements 32, 34 in place. Additionally, the foam filler provides a moisture/debris barrier and improves the overall structural integrity of the antenna assembly. A variety of setting foam fillers may be utilized during manufacture of the antenna assembly.

According to various embodiments of the invention, the antenna and transceiver may be deployed with additional technologies. For example, the antenna and transceiver may be deployed with technologies designed to assess and screen persons, parties, and/or vehicles approaching a designated location, such as, for instance, checkpoints and/or facilities. The screening technologies may be designed to detect bombs being transported by people, within vehicles, or other (e.g., vehicle borne IEDs used in suicide attacks).

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A biconical antenna assembly comprising:

a pair of generally cone-shaped conductive elements directed in divergent directions, with one of the pair of conductive elements including a generally conical sheet conductor and a generally cylindrical sheet conductor, and a first plurality of radiating conductors conductively attached to and extending away from the cylindrical sheet conductor, and with the other conductive element including a generally cylindrical sheet conductor and a generally conical sheet conductor, and a second plurality of radiating conductors conductively attached to and extending away from the cylindrical sheet conductor, with a feed point defined between the conical sheet conductors of the pair of conductive elements;

a balun including a coiled section of a coax signal line and a magnetic core, said balun being coupled to the feed point; and a tubular radome enclosing at least portions of the plurality of radiating conductors, wherein the plurality of radiating conductors are covered with a flexible protective element.

2. A biconical antenna assembly comprising:

a pair of generally cone-shaped conductive elements directed in divergent directions, with one of the pair of conductive elements including a generally conical sheet conductor and a generally cylindrical sheet conductor, and a first plurality of radiating conductors conductively attached to and extending away from the cylindrical sheet conductor, and with the other conductive element including a generally cylindrical sheet conductor and a generally conical sheet conductor, and a second plurality of radiating conductors conductively attached to and extending away from the cylindrical sheet conductor, with a feed point defined between the conical sheet conductors of the pair of conductive elements;

a balun including a coiled section of a coax signal line and a magnetic core, said balun being coupled to the feed point; and a tubular radome enclosing at least portions of the plurality of radiating conductors, wherein the plurality of radiating conductors are of a resilient material, such that upon a deformation in response to an external force, the plurality of radiating conductors return to a pre-deformation orientation.

3. The biconical antenna assembly of claim 2 wherein the second plurality of radiating conductors are positioned within 180 degrees.

4. The biconical antenna assembly of claim 3 wherein the second plurality of radiating conductors are equally spaced around one side of the cylindrical sheet conductor.

5. The biconical antenna assembly of claim 2 wherein the first plurality of radiating conductors are generally equally spaced around the conical sheet conductor.

6. The biconical antenna assembly of claim 2 wherein the radiating conductors include one or more chokes.

7. The biconical antenna assembly of claim 6 wherein the chokes are defined as a plurality of loops.

8. The biconical antenna assembly of claim 2 wherein a center conductor of a coax signal line is connected to an upper conical sheet conductor and a shield conductor of the coax line is connected to a lower conical sheet conductor.

9. The biconical antenna of claim 8 wherein the coax signal line extends through a center opening in the lower conical sheet conductor.

10. A biconical antenna assembly comprising:

a pair of generally cone-shaped conductive elements directed in divergent directions, with one of the pair of conductive elements including a generally conical sheet conductor and a generally cylindrical sheet conductor, and a first plurality of radiating conductors conductively attached to and extending away from the cylindrical sheet conductor, and with the other conductive element including a generally cylindrical sheet conductor and a generally conical sheet conductor, and a second plurality of radiating conductors conductively attached to and extending away from the cylindrical sheet conductor, with a feed point defined between the conical sheet conductors of the pair of conductive elements;

a balun including a coiled section of a coax signal line and a magnetic core, said balun being coupled to the feed point; and a tubular radome enclosing at least portions of the plurality of radiating conductors, wherein the radome includes a pair of tubular sections designed to receive portions of the radiating conductors.

11. The biconical antenna of claim 10 wherein the radome includes at least one dielectric spacer element positioned in an interior of one of the pair of tubular sections, said spacer element for maintaining a separation between the radiating conductors.

12. The biconical antenna of claim 10 wherein the radome includes at least one dielectric transition for mechanically connecting a pair of radome sections together.

13. A biconical antenna assembly comprising:

a pair of generally cone-shaped conductive elements directed in divergent directions, with one of the pair of conductive elements including a generally conical sheet conductor and a generally cylindrical sheet conductor, and a first plurality of radiating conductors conductively attached to and extending away from the cylindrical sheet conductor, and with the other conductive element including a generally cylindrical sheet conductor and a generally conical sheet conductor, and a second plurality of radiating conductors conductively attached to and extending away from the cylindrical sheet conductor, with a feed point defined between the conical sheet conductors of the pair of conductive elements;

a balun including a coiled section of a coax signal line and a magnetic core, said balun being coupled to the feed point; and a tubular radome enclosing at least portions of the plurality of radiating conductors, wherein the radome includes at least one dielectric transition for mechanically connecting a pair of generally tubular radome sections together.

14. The biconical antenna of claim 13 wherein the radome includes a foam filler in one or more cavities of the radome.

15. A biconical antenna assembly comprising:

a first sheet conductor including a generally conical sheet conductor and a generally cylindrical sheet conductor conductively attached to a plurality of radiating conductors, said conductors extending away from the cylindrical sheet conductor to define a generally conical form;

a second sheet conductor including a generally conical sheet conductor and a generally cylindrical sheet conductor attached to a plurality of radiating conductors extending away from the conductor to define at least a portion of a conical form, said radiating conductors extending in generally opposite directions as compared to the radiating conductors attached to the first sheet conductor, and with a feedpoint defined between the first and second sheet conductors;

a balun including a coiled section of a coax signal line surrounding a magnetic core, with the coax signal line being coupled to the feedpoint; and a radome assembly for enclosing at least some of the plurality of radiating conductors, wherein the radome assembly includes at least one dielectric spacer element for maintaining a separation between the radiating conductors.

16. A biconical antenna assembly comprising:

a first sheet conductor including a generally conical sheet conductor and a generally cylindrical sheet conductor conductively attached to a plurality of radiating conductors, said conductors extending away from the cylindrical sheet conductor to define a generally conical form;

a second sheet conductor including a generally conical sheet conductor and a generally cylindrical sheet conductor attached to a plurality of radiating conductors extending away from the conductor to define at least a portion of a conical form, said radiating conductors extending in generally opposite directions as compared to the radiating conductors attached to the first sheet conductor, and with a feedpoint defined between the first and second sheet conductors;

a balun including a coiled section of a coax signal line surrounding a magnetic core, with the coax signal line being coupled to the feedpoint; and a radome assembly for enclosing at least some of the plurality of radiating conductors, wherein the radome assembly include at least one transition element for mechanically coupling a pair of radome sections together.

17. A biconical antenna assembly comprising:

an upper feed element including a generally cylindrical sheet conductor and a generally conical sheet conductor, with the cylindrical sheet conductor conductively attached to a plurality of radiating conductors, said conductors extending away from the cylindrical sheet conductor;

a lower feed element including a generally conical sheet conductor and a generally cylindrical sheet conductor, with the cylindrical sheet conductor attached to a plurality of radiating conductors extending away from the cylindrical sheet conductor, said radiating conductors extending in generally opposite directions as compared to the radiating conductors attached to the upper feed element;

a feedpoint adapted for connection to an RF transceiver, said feedpoint being defined between the upper feed element and the lower feed element;

a balun coupled to the feedpoint and including a section of coax signal line coiled about a magnetic core; and a radome enclosing at least some of the radiating conductors, with the radome including at least one interior dielectric spacer element for maintaining a separation between the radiating conductors within the radome.

18. The biconical antenna assembly of claim 17 wherein at least some of the plurality of radiating conductors include a pair of RF chokes, with the pair of RF chokes being selected to optimize operation of the antenna assembly across a predetermined frequency range.

19. The biconical antenna of claim 17 wherein the radome includes a pair of tubular sections designed to receive portions of the radiating conductors.

20. The biconical antenna of claim 17 wherein the radome includes at least one dielectric transition element for mechanically connecting a pair of radome sections together.

* * * * *